US005586523A

United States Patent [19]

Kawahara et al.

[11] Patent Number: 5,586,523

[45] Date of Patent: Dec. 24, 1996

[54] CRANKCASE COMPRESSION TYPE TWO-CYCLE ENGINE

[75] Inventors: Yoshitaka Kawahara; Kazunori Kudo; Yoshihide Nakatani; Hiroyuki Takagawa, all of Nagoya, Japan

[73] Assignee: Mitsubishi Jukogyo Kabushiki Kaisha, Tokyo, Japan

[21] Appl. No.: 531,827

[22] Filed: Sep. 21, 1995

Related U.S. Application Data

[63] Continuation of Ser. No. 224,288, Mar. 28, 1994, abandoned.

[30] Foreign Application Priority Data

Mar. 31, 1993 [JP] Japan ..... 5-094898
Dec. 28, 1993 [JP] Japan ..... 5-348923

[51] Int. Cl.[6] ..... F02B 25/04; F02B 29/00

[52] U.S. Cl. ..... 123/65 VB; 123/73 AB; 123/73 BA

[58] Field of Search ..... 123/73 AB, 73 BA, 123/73 R, 73 CA, 65 VB, 339, 478, 90.11, 90.15, 90.16, 90.17

[56] References Cited

U.S. PATENT DOCUMENTS

| | | | |
|---|---|---|---|
| 1,759,187 | 5/1930 | Davidson | 123/65 VB |
| 1,762,214 | 6/1930 | Cartwright | 123/65 VB |
| 2,256,437 | 9/1941 | Kylen | 123/73 AB |
| 3,687,118 | 8/1972 | Nomura | 123/73 R |
| 4,538,569 | 9/1985 | Sugino et al. | 123/90.11 |
| 5,005,537 | 4/1991 | Maissant | 123/65 VB |
| 5,031,594 | 7/1991 | Morikawa | 123/339 |
| 5,062,396 | 11/1991 | Duret et al. | 123/73 BA |
| 5,103,780 | 4/1992 | Ishii | 123/90.17 |
| 5,247,914 | 9/1993 | Imai et al. | 123/90.17 |
| 5,284,118 | 2/1994 | Kato et al. | 123/478 |

FOREIGN PATENT DOCUMENTS

| | | |
|---|---|---|
| 16520 | 7/1920 | Australia . |
| 21811 | 2/1925 | Australia . |
| 201839 | 5/1956 | Australia . |
| 55-23315 | 2/1980 | Japan . |
| 2-207130 | 8/1990 | Japan . |

*Primary Examiner*—Marguerite McMahon
*Attorney, Agent, or Firm*—Wenderoth, Lind & Ponack

[57] ABSTRACT

The present invention provides a crankcase compression type two-cycle engine which has a comparatively simple construction, is capable of operating at a low fuel consumption and discharges an exhaust gas having a comparatively low hydrocarbon concentration. The engine comprises a crankcase, a piston, a cylinder joined to the crankcase and provided in its lower part with an exhaust port which is opened and closed by the piston, a cylinder head attached to the upper end of the cylinder, and forming a combustion chamber together with the cylinder and the piston. A poppet scavenging valve is provided in the upper part of the cylinder so as to be opened to the combustion chamber side. A diaphragm actuator operates the poppet scavenging valve using the pressure within the crankcase. The diaphragm actuator is provided with a diaphragm that receives the pressure within the crankcase on one side thereof and receives the pressure of a spring on the other side thereof. Further, a passage for introducing the pressure within the crankcase into the diaphragm actuator is connected to a scavenging passage. A fuel supply system may be connected to the scavenging passage to supply the fuel into the scavenging passage.

15 Claims, 9 Drawing Sheets

CRANKCASE COMPRESSION TYPE TWO-CYCLE ENGINE

This application is a Continuation of now abandoned application Ser. No. 08/224,288, filed on Mar. 28, 1994.

BACKGROUND OF THE INVENTION

1. Field of the Invention:

The present invention relates to a small-capacity crankcase compression type two-cycle gasoline engine.

2. Description of the Related Art:

Referring to FIG. 8 showing a conventional small-capacity crankcase compression type two-cycle gasoline engine by way of example, there are shown a cylinder 1' provided with a scavenging hole 6', a piston 2', a crankshaft 3', a connecting rod 4', a crankcase 5' having a crank chamber, a cylinder head 8', a combustion chamber 9', an ignition plug 12', and a scavenging passage 61' connecting the crank chamber of the crankcase 5' to the scavenging hole 6'. In FIG. 8, the exhaust port of the cylinder 1' is not shown. The piston 2' is forced to move downward by the pressure of a combustion gas 13' produced by the combustion of a fuel-air mixture within the combustion chamber 9' to rotate the crankshaft 3' through the connecting rod 4'. As the piston 2' moves downward, the exhaust hole, not shown, opens gradually to allow the combustion gas to flow out of the combustion chamber 9' and, at the same time, a fuel-air mixture previously taken into the crankcase 5' through an intake hole, not shown, is compressed within the crankcase 5', and it is introduced into the combustion chamber 9' through the scavenging hole 6' to scavenge the combustion gas. This scavenging system is called a Schnüle type scavenging system and its gas exchange pattern is shown in FIG. 9.

In the engine of this type, both of the scavenging hole and the exhaust port are provided at the side of the cylinder and are adjacent to each other. Accordingly, the fresh air 14' tends to escape directly from the scavenging hole to the exhaust port. Especially in the engine in which fuel is premixed with the fresh air by a carburetor, fuel content is included in the escaping fresh air as above, and hence, the fuel consumption rate is deteriorated and the hydrocarbon concentration in the exhaust gas becomes high. However, the Schnüle type engine has advantages in that an exhaust valve and a driving mechanism therefor, of it such as a cam or a rocker arm, are unnecessary and, therefore, the construction is simple.

In order to solve the problem of the escape of part of the fuel-air mixture in the Schnüle type scavenging system, a uniflow scavenging type two-cycle engine is proposed. In FIG. 10, one example of this uniflow scavenging type two-cycle engine is shown.

In FIG. 10, an exhaust valve 11' provided in a cylinder head 8' is driven to open and close an exhaust port 7' by a valve operating mechanism comprising a cam 36' mounted on a crankshaft 3', a valve tappet 13', a push rod 14' and a rocker arm 15'. The fuel-air mixture precharged in a crankcase 5' flows through a scavenging hole 6 into a combustion chamber 9' to scavenge the combustion gas remaining within the combustion chamber 9' so that the combustion gas 13' will be discharged through the exhaust port 7'. The flow pattern of the gas exchange in the uniflow scavenging type two-cycle engine is illustrated in FIG. 11.

Although the Schnüle scavenging type two-cycle engine shown in FIG. 8 has a simple construction, the Schnüle scavenging type two-cycle engine, especially in a case where the fuel is premixed with the fresh air by the carburetor, is disadvantageous in that its fuel consumption rate is high and its exhaust gas has a high hydrocarbon concentration because the cylinder is scavenged with the fuel-air mixture and a part of the fuel-air mixture escapes together with the combustion gas through the exhaust port. Hereinafter, the escape of a part of the fuel-air mixture together with the combustion gas is called "blowby" in this specification.

The uniflow scavenging type two-cycle engine shown in FIG. 10 proposed to suppress the direct discharge of the fuel-air mixture needs the valve operating mechanism and hence has a complex construction. Although it is most effective in reducing wasteful fuel consumption attributable to the blowby of the fuel-air mixture to inject the fuel directly into the combustion chamber 9' after the exhaust port has been closed, the fuel must be injected at a high pressure into the combustion chamber 9' to produce a fuel-air mixture immediately within the combustion chamber 9', which requires a cam, an injection pump and the associated parts for high-pressure fuel injection, and the fuel injection mechanism makes the construction of the uniflow scavenging type two-cycle engine more complex.

SUMMARY OF THE INVENTION

Accordingly it is an object of the present invention to provide an improved two-cycle engine incorporating the simple, lightweight construction of the Schnüle scavenging type two-cycle engine, and capable of preventing the blowby of the fuel-air mixture, of operating at an improved fuel consumption and of discharging an improved exhaust gas having a reduced hydrocarbon concentration.

With the foregoing object in view, the present invention provides a crankcase compression type two-cycle engine characterized in that:

(1) an exhaust port is formed in the lower part of a cylinder so as to be closed and opened when a piston moves past the bottom dead point, a poppet scavenging valve is provided in the upper part of the cylinder to be opened to the combustion chamber side and also a valve operating means for opening the scavenging valve using the pressure of the gas compressed in the crankcase in a state where the piston is moving in the vicinity of the bottom dead center;

(2) the valve operating means is a diaphragm actuator provided with a diaphragm that receives the pressure of a spring on one side thereof and the pressure of the gas compressed in the crankcase on the other side thereof, and capable of operating by the difference between the pressure of the spring and the pressure of the gas compressed in the crankcase;

(3) a passage through which the pressure of the gas compressed in the crankcase is applied to the valve operating means is connected to a scavenging passage;

(4) an exhaust port and a scavenging hole are formed in the lower part of a cylinder so as to be opened and closed by a piston as the piston moves toward and past the bottom dead center, a combustion chamber formed in the top part of the cylinder and interior of the crankcase are connected by a scavenging passage, at least one scavenging valve is disposed in a top part of the cylinder, and a fuel supply system is connected to the scavenging passage at a position upstream of the scavenging valve to supply the fuel into the scavenging passage;

(5), an intake device which takes only air into the crankcase is provided;

(6), the scavenging valve is of an electromagnetic type with a solenoid which is energized by a crank angle sensor and operated by an electromagnetic force thereof;

(7), the scavenging valve is of a diaphragm actuator type operated by a diaphragm on which pressure of the gas compressed in the crankcase and force of a spring act;

(8), the fuel supply system is of a carburetor type having an intake passage connected through a reed valve to the scavenging passage;

(9), the fuel supply system is of a fuel injection type having a fuel injection valve disposed in the scavenging passage and immediately upstream of the scavenging valve and a fuel pump for supplying the fuel to the fuel injection valve under pressure;

(10), the scavenging passage connected to the top part of the cylinder is provided with a throttling means; and (11), the crankcase compression type two-cycle engine is provided with a plurality of scavenging valves.

In the crankcase compression type two-cycle engine characterized by (1) to (3), the exhaust port of the cylinder starts opening as the piston moves downward in the final stage of the expansion stroke to discharge the combustion gas through the exhaust port, so that the pressure within the cylinder decreases, while the fuel-air mixture charged in the crankcase is compressed by the downward movement of the piston. The fuel-air mixture flows through the scavenging passage toward the scavenging valve, the pressure of the fuel-air mixture acts on the valve operating means, such as the diaphragm actuator, to open the scavenging valve, the fuel-air mixture flows into the combustion chamber and, consequently, the pressure of the gas within the crankcase decreases. Then, as the piston moves upward, the exhaust port is closed, the pressure of the fuel-air mixture increases gradually as the same is compressed by the rising piston and the scavenging valve is closed.

In the crankcase compression type two-cycle engine characterized by (4), (5) and (7), the fuel or a fuel-air mixture is mixed in the air flowing from the crankcase through the scavenging passage at a position immediately upstream of the scavenging valve by the fuel supply system, such as a carburetor, and the scavenging valve is opened by the diaphragm actuator to allow the fuel-air mixture to flow into the combustion chamber.

In the crankcase compression type two-cycle engine characterized by (6), the solenoid is energized when the crank angle sensor provides a valve opening and closing signal upon the detection of a specified crank angle to open and close the scavenging valve by the electromagnetic force generated by the solenoid (or the electromagnetic force and the pressure of a spring).

In the crankcase compression type two-cycle engine characterized by (8), the fuel-air mixture made by the carburetor flows through the reed valve into the scavenging passage and flows into the combustion chamber when the scavenging valve is opened.

In the crankcase compression type two-cycle engine characterized by (9) to (11), a fuel-air mixture is produced by injecting the fuel by the fuel injection valve into the compressed air flowing through the scavenging passage, and the fuel-air mixture flows through one or a plurality of scavenging valves into the combustion chamber for burning. The throttling means adjusts the flow passage area of the scavenging passage.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
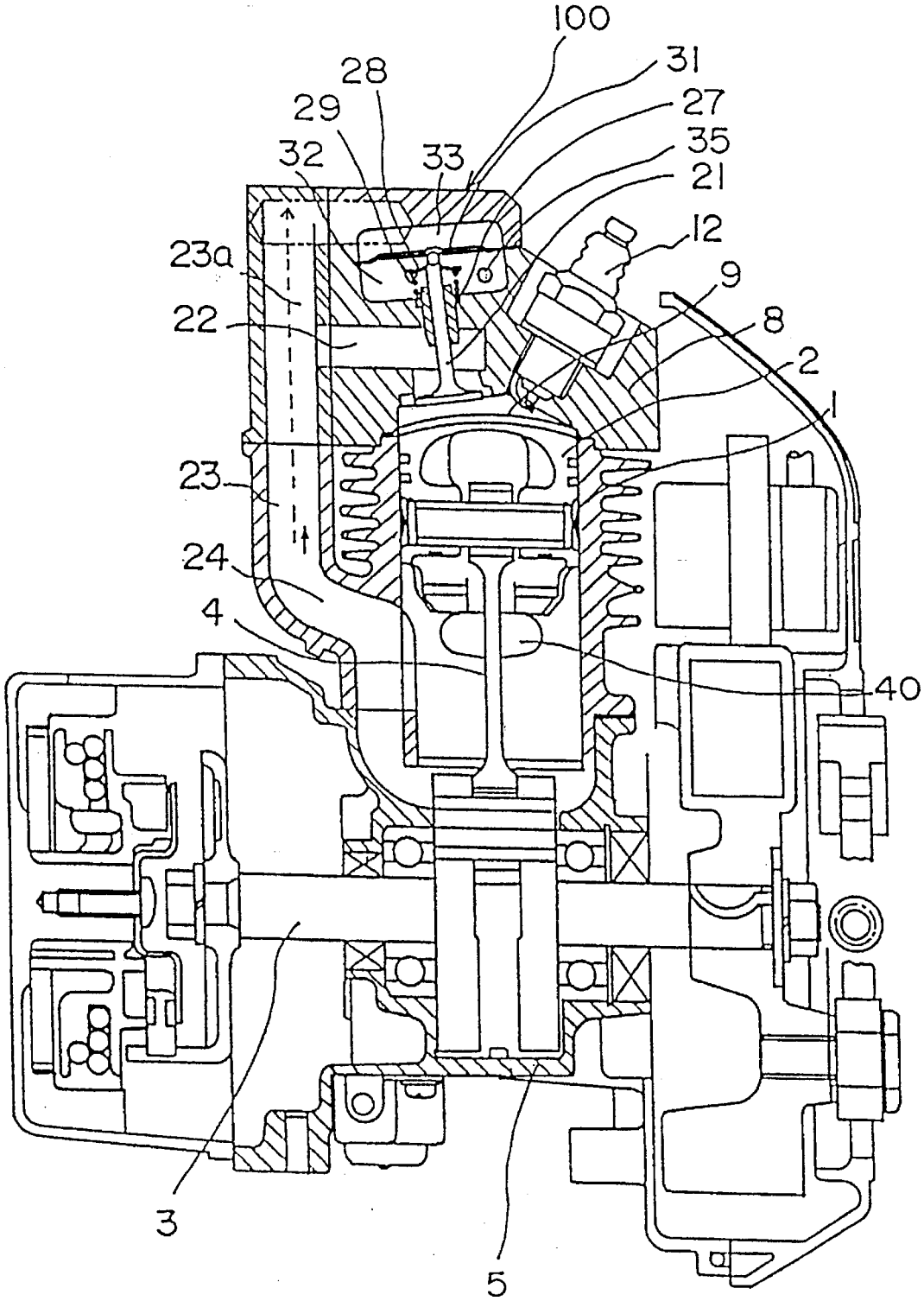
FIG. 1 is a schematic sectional view of a crankcase compression type two-cycle engine in a first embodiment according to the present invention.

Referring to FIG. 1, a crankcase compression type two-cycle engine (hereinafter referred to simply as "engine") in a first embodiment according to the present invention comprises, as principal components, a cylinder 1, a piston 2, a crankshaft 3, a connecting rod 4, a crankcase 5, a cylinder head 8, an ignition plug 12 (spark plug), a scavenging valve 21, i.e., a poppet valve, provided on the cylinder head 8 to be pressed axially into the cylinder 1 to open a scavenging port 22 formed in the cylinder head 8, and a diaphragm actuator 100 for operating the scavenging valve 21. A combustion chamber 9 is defined by the cylinder 1, the piston 2 and the cylinder head 8. The diaphragm actuator 100 has a diaphragm 31 partitioning a cavity formed in the cylinder head 8 so as to receive the upper end of the scavenging valve 21 into a valve chamber 32 and a pressure chamber 33. The scavenging valve 21 is biased toward the closed position by a valve spring 29 retained by a valve spring retainer 28 fastened to the stem of the scavenging valve 21.

The cylinder 1 is provided with a scavenging hole 24 and an exhaust port 40 in its lower part, and a scavenging passage 23 having a lower end opening into the crankcase 5 and an upper end connected to the pressure chamber 33 and a scavenging port 22. The stem of the scavenging valve 21 is supported for axial movement in a valve guide 27 attached to the cylinder head 8. The valve chamber 32 communicates with the atmosphere by means of a hole 35. The scavenging passage 23 is branched in the cylinder head 8 into an operating air passage 23*a* connected to the pressure chamber 33, and a branch passage connected to the scavenging port 22 opened and closed by the scavenging valve 21.

In operation, upon the arrival of the piston 2 at a specified position during the expansion stroke, the exhaust port 40 is opened to discharge the combustion gas through the exhaust port 40. As the piston 2 moves downward, the fuel-air mixture previously supplied through an intake passage, not shown, into the crankcase 5 is compressed. The pressure of the compressed fuel-air mixture prevails in the scavenging passage 23, the scavenging port 22, the operating air passage 23*a* and the pressure chamber 33. As the piston 2 moves further downward, the opening of the exhaust port 40 increases, the internal pressure of the combustion chamber 9 decreases and the pressure of the fuel-air mixture compressed in the crankcase 5 increases. Eventually, the pressure of the fuel-air mixture prevailing in the pressure chamber 33 and acting on the diaphragm 31 exceeds the resilience of the valve spring 29 and, consequently, the scavenging valve 21 is moved into the combustion chamber 9 to open the scavenging port 22 into the combustion chamber 9, so that the fuel-air mixture flows through the scavenging valve 21 into the combustion chamber 9. Then, the fuel-air mixture flows downward from the upper part of the interior of the cylinder 1 near the scavenging valve 21 toward the lower part of the interior of the cylinder 1 near the exhaust port 40 to scavenge the cylinder 1. As the piston 2 moves upward for the compression stroke, the crankcase 5 is evacuated, so that the intake passage, not shown, formed in the lower part of the cylinder 1 is opened to suck the fuel-air mixture made by a carburetor, not shown, into the crankcase 5.

Figure 2:
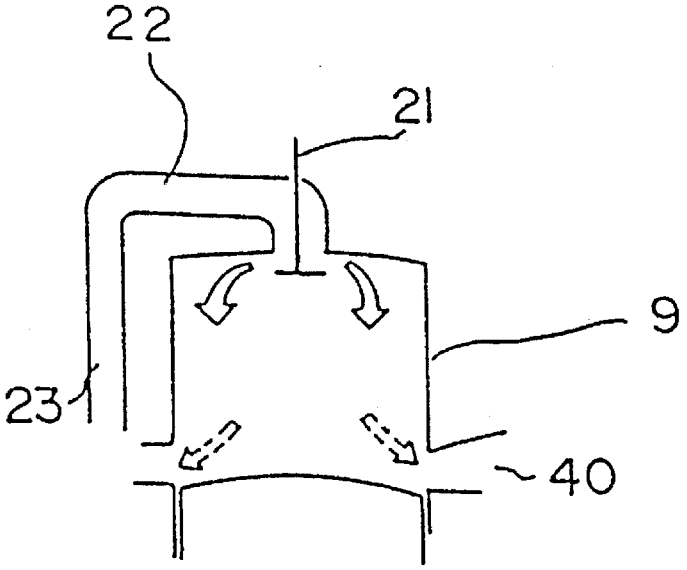
FIG. 2 is a diagrammatic view illustrating the flow pattern of the gas exchange in the two-cycle engine of FIG. 1.
Figure 10:
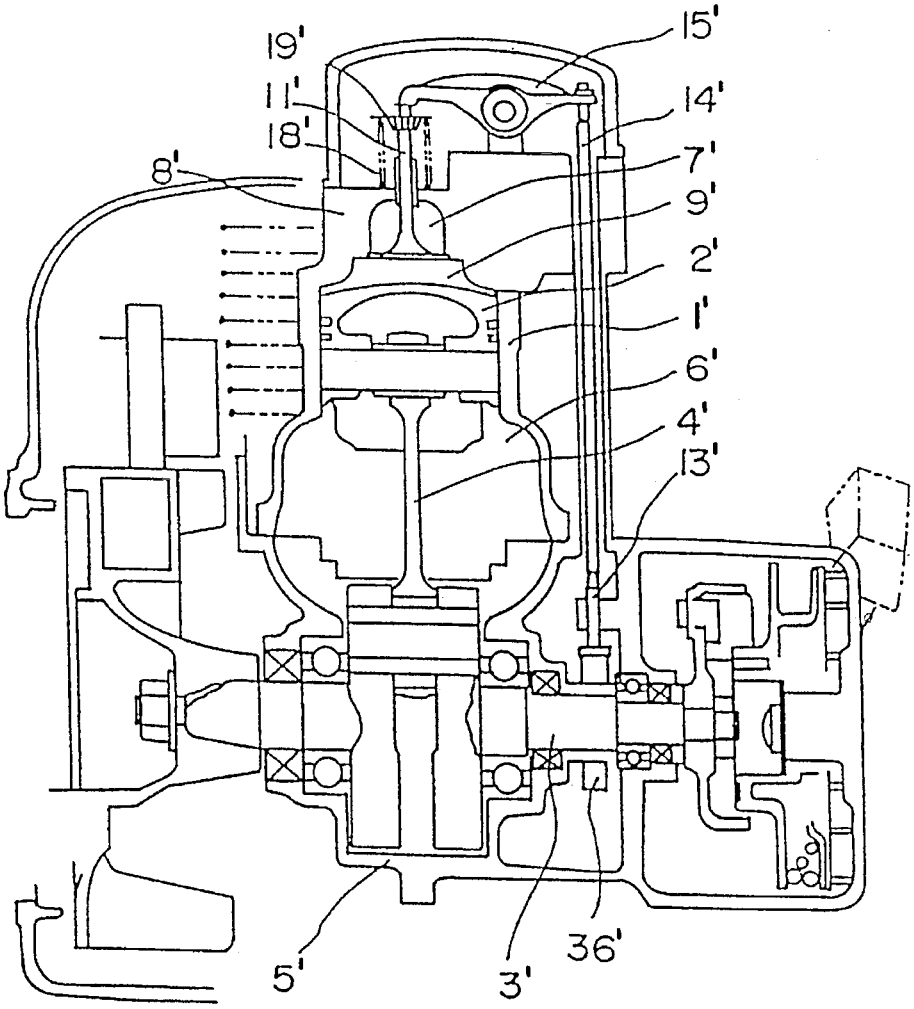
FIG. 10 (PRIOR ART)
FIG. 10 is a schematic sectional view of a conventional uniflow scavenging type two-cycle engine.
Figure 11:
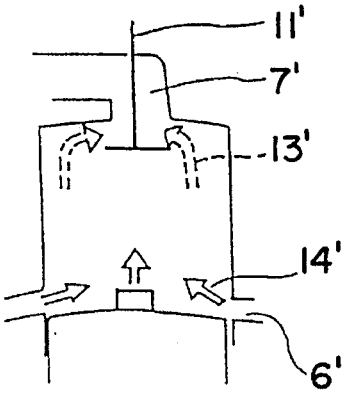
FIG. 11 (PRIOR ART)
FIG. 11 is a diagrammatic view illustrating the flow pattern of the gas exchange in the two-cycle engine of FIG. 10.

As shown typically in FIG. 2, the flow of the fuel-air mixture and the combustion gas within the cylinder 1 is of a simple uniflow, which is similar to that of the fuel-air mixture and the combustion gas in the cylinder of the uniflow scavenging type two-cycle engine of FIG. 10, except that the direction of flow of the fuel-air mixture and the combustion gas is reverse to that of flow of the fuel-air mixture and the combustion gas in the cylinder of the uniflow scavenging type two-cycle engine of FIG. 10. Only a very small quantity of the fuel content blows by through the exhaust port 40.

A crankcase compression type two-cycle engine in a second embodiment according to the present invention will be described hereinafter with reference to FIGS. 3 and 4(A) to 4(D).

Figure 3:
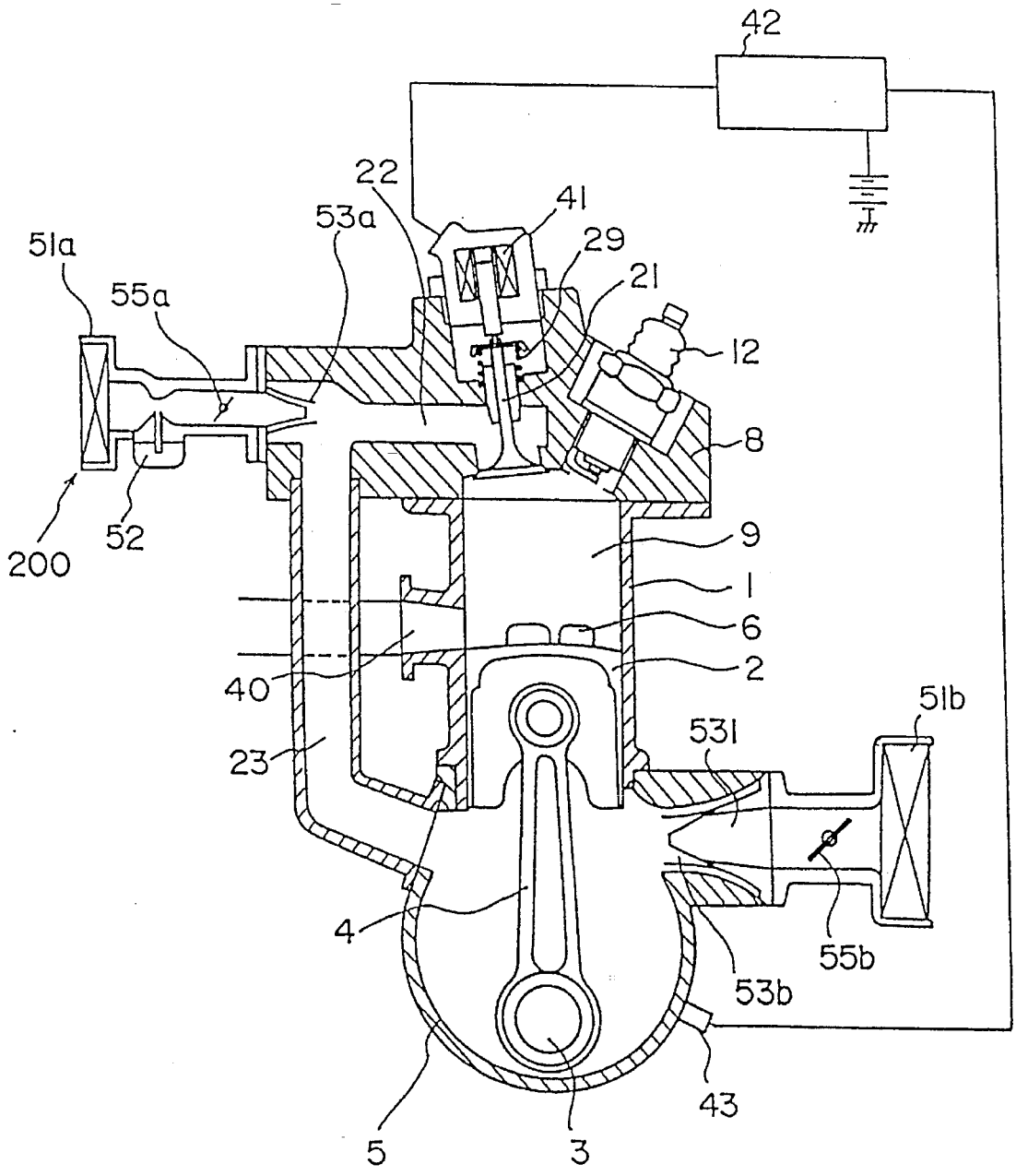
FIG. 3 is a schematic sectional view, similar to FIG. 1, of a crankcase compression type two-cycle engine in a second embodiment according to the present invention.

Shown in FIG. 3 are a cylinder 1, a piston 2, a crank shaft 3, a connecting rod 4, a crankcase 5, a cylinder head 8, a combustion chamber 9 and an ignition plug 12.

The cylinder is provided with an exhaust port 40 and a lower scavenging hole 6 in its lower part. The scavenging hole 6 has an area smaller than that of the scavenging hole of an equivalent conventional two-cycle engine. The crankcase 5 is provided with an intake passage 531 provided with a reed valve 53*b*. Fresh air is sucked through an air cleaner 51*b* and the intake passage 531 into the crankcase 5. A poppet scavenging valve 21 is supported for axial movement on the cylinder head 8 and is biased toward the closed position with a valve spring 29. The scavenging valve 21 is pushed into the combustion chamber 9 to be opened. The scavenging passage 23 has a lower end connected to the crankcase 5 and an upper end connected to the upper scavenging port 22. The scavenging valve 21 is operated by a solenoid 41 which is driven by an electrical solenoid circuit 42. A crank angle sensor 43 gives a crank angle signal indicating a specified crank angle of the engine to the solenoid circuit 42. The solenoid circuit 42 sends signals to the solenoid 41 so as to open the scavenging valve 21 with a slight delay after the scavenging hole 6 has been opened and to close the scavenging valve 21 substantially simultaneously with the closing of the exhaust port 40. A fuel supply system 200 is disposed near the upper end of the scavenging passage 23. The fuel supply system 200 comprises a reed valve 53*a*, an air cleaner 51*a*, a throttle valve 55*a* and a carburetor 52. A fuel-air mixture made by the carburetor 52 flows through the reed valve 53*a* into the upper scavenging port 22. The throttle valve 55*a* of the fuel supply system 200 and a throttle valve 55*b* disposed in the fresh air passage 531 are interlocked mechanically and the respective openings of the throttle valves 55*a* and 55*b* are regulated according to the load on the engine.

Figure 4A:
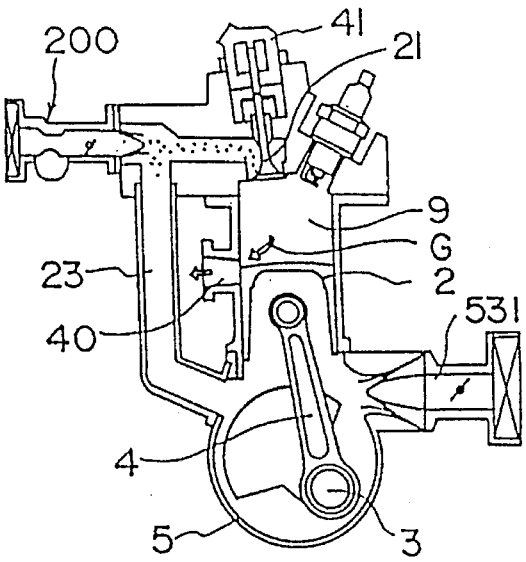
FIGS. 4(A), 4(B), 4(C) and 4(D) are schematic sectional views for explaining the operation of the two-cycle engine of FIG. 3.
Figure 4B:
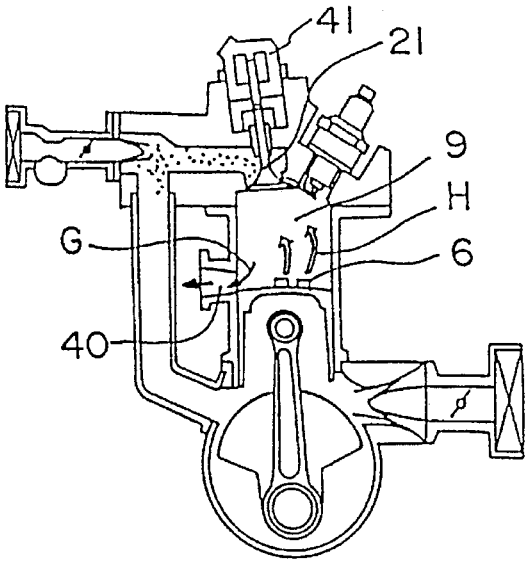

The operation of the engine in the second embodiment will be described hereinafter with reference to FIGS. 3 and 4(A) to 4(D). In the expansion stroke, as the piston 2 moves downward turning the crankshaft 3 through the connecting rod 4, first the exhaust port 40 is opened and the high-pressure combustion gas G flows out of the combustion chamber 9 into the muffler as shown in FIG. 4(A). As the piston moves further downward, the scavenging hole 6 is opened to allow compressed fresh air H compressed in the crankcase 5 by the piston 2 moving downward to flow through the lower scavenging hole 6 into the combustion chamber 9 to scavenge the combustion chamber 9 as shown in FIG. 4(B). Then the solenoid 41 opens the scavenging valve 21 with a slight delay after the lower scavenging hole 6 has been opened. Since the exhaust port 40 is open and the pressure within the combustion chamber 9 is comparatively low, the fuel-air mixture J, made by the carburetor 52 of the fuel supply system 200 connected to the inlet of the upper scavenging port 22 and filled in the scavenging port 22 and the scavenging passage 23, is urged to flow through the scavenging valve 21 into the combustion chamber 9.

Figure 4C:
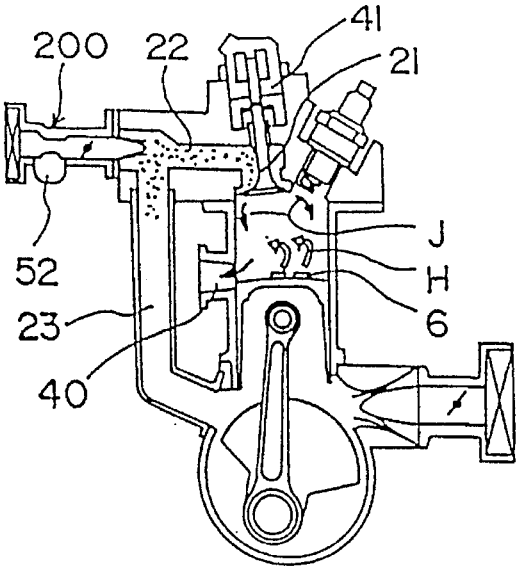

The fresh air H supplied through the scavenging hole 6 at the lower part of the cylinder into the combustion chamber 9 collides with the flow of the fuel-air mixture J supplied through the scavenging valve 21 into the combustion chamber 9 as shown in FIG. 4(C) to suppress the blowby of the fuel-air mixture J through the discharge port 40.

Figure 4D:
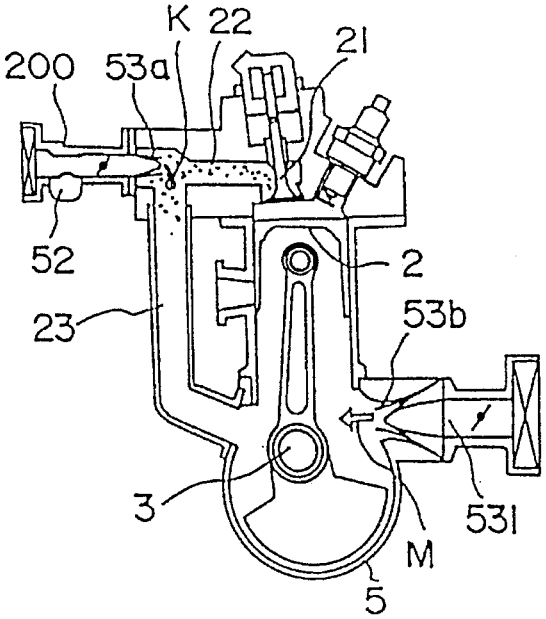

In the compression stroke where the piston 2 moves upward, the scavenging hole 6, the exhaust port 40 and the scavenging valve 21 are closed, the fuel-air mixture J is compressed in the cylinder 1, and the pressure within the crankcase 5, the scavenging port 22 and the scavenging passage 23 decreases. Upon the drop of this pressure to a fixed pressure, the reed valve 53*a* of the fuel supply system 200 and the reed valve 53*b* disposed in the intake passage 531 open substantially simultaneously to supply the fuel-air mixture made by the carburetor 52 into the scavenging passage 23 and the scavenging port 22 and to suck fresh air through the reed valve 53*b* into the crankcase 5. Consequently, the scavenging port 22 and the upper part of the scavenging passage 23 are filled up with the new fuel-air mixture K as shown in FIG. 4(D).

In this embodiment, lubricating oil is injected into a space near the throttle valve 55*b* within the intake passage 531 by a known separate oiling system to blow the lubricating oil into the crankcase 5.

A crankcase compression type two-cycle engine in a third embodiment according to the present invention will be described hereinafter with reference to FIG. 5. The engine in the third embodiment is substantially the same in construction as the engine in the second embodiment, except that the engine in the third embodiment employs a fuel supply system different from the fuel supply system 200 of the second embodiment provided with the carburetor 52. Therefore parts like or corresponding to those shown in FIG. 3 are denoted by the same reference characters and the description thereof will be omitted.

Figure 5:
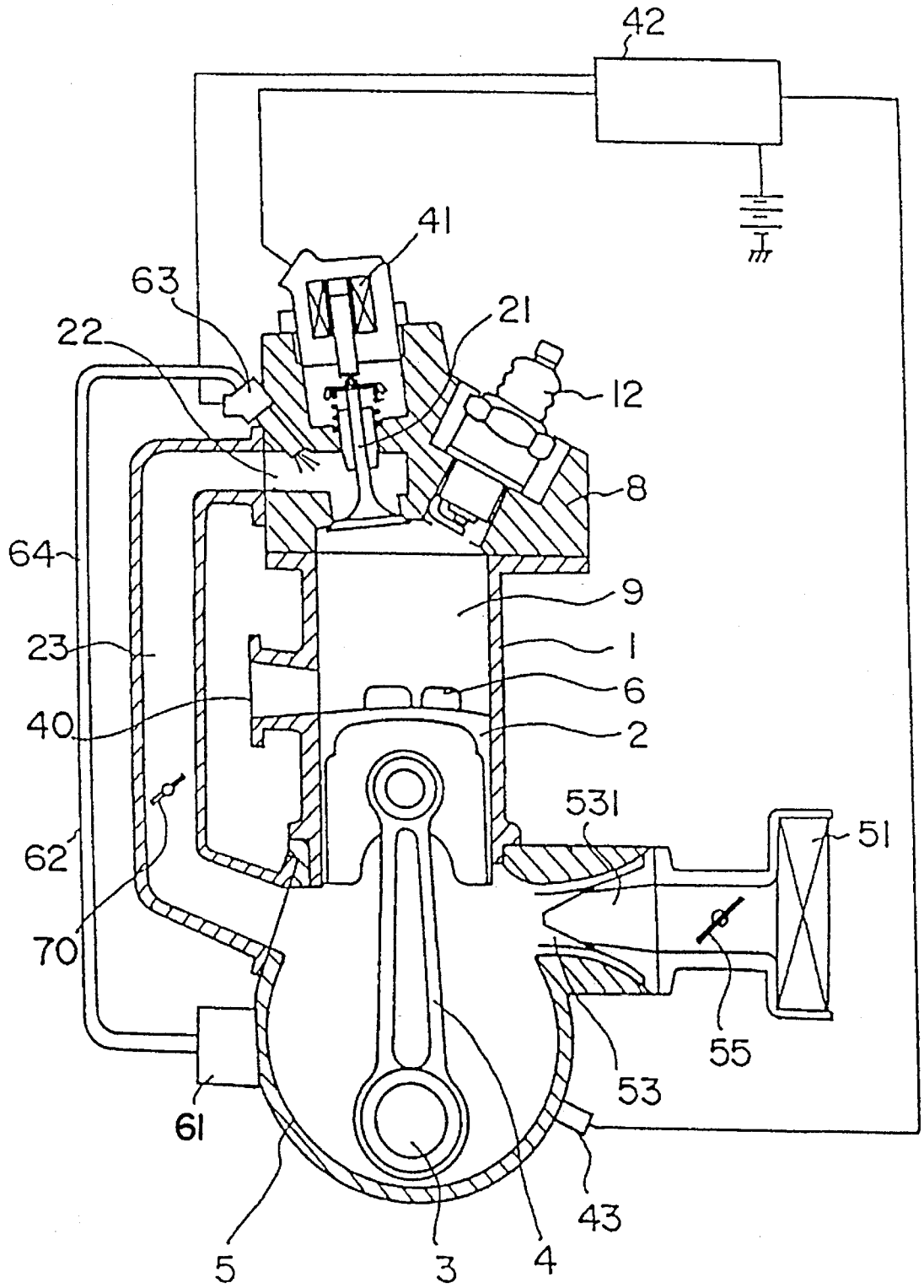
FIG. 5 is a schematic sectional view, similar to FIG. 1, of a crankcase compression type two-cycle engine in a third embodiment according to the present invention.

Referring to FIG. 5, the engine is provided with a fuel supply system comprising a fuel pump 61 and a fuel injection valve 63 connected to the fuel pump 61 by a fuel supply pipe 64 and disposed so as to inject the fuel into the scavenging port 22. The fuel injection rate and the fuel injection time of the fuel injection valve 63 are controlled in synchronism with the operation of the scavenging valve 21 by the circuit 42 for driving the solenoid 41 for operating the scavenging valve 21. The scavenging passage 23 is provided with a throttle valve 70 for regulating the flow passage area of the scavenging passage 23.

In the engine of the third embodiment, the fresh air compressed in the crankcase 5 by the piston 2 moving downward flows through the scavenging passage 23 into the scavenging port 22, and then the fuel injection valve 63 injects the fuel into the fresh air with an appropriate timing to produce a fuel-air mixture. The fuel-air mixture is supplied into the combustion chamber 9 when the scavenging valve 21 is opened. The flow ratio between the fuel-air mixture that flows into the cylinder 1 when the scavenging valve 21 is opened and the fresh air that flows through the scavenging hole 6 into the cylinder 1 is regulated by controlling the opening of the throttle valve 70 provided in the scavenging passage 23.

Figure 6:
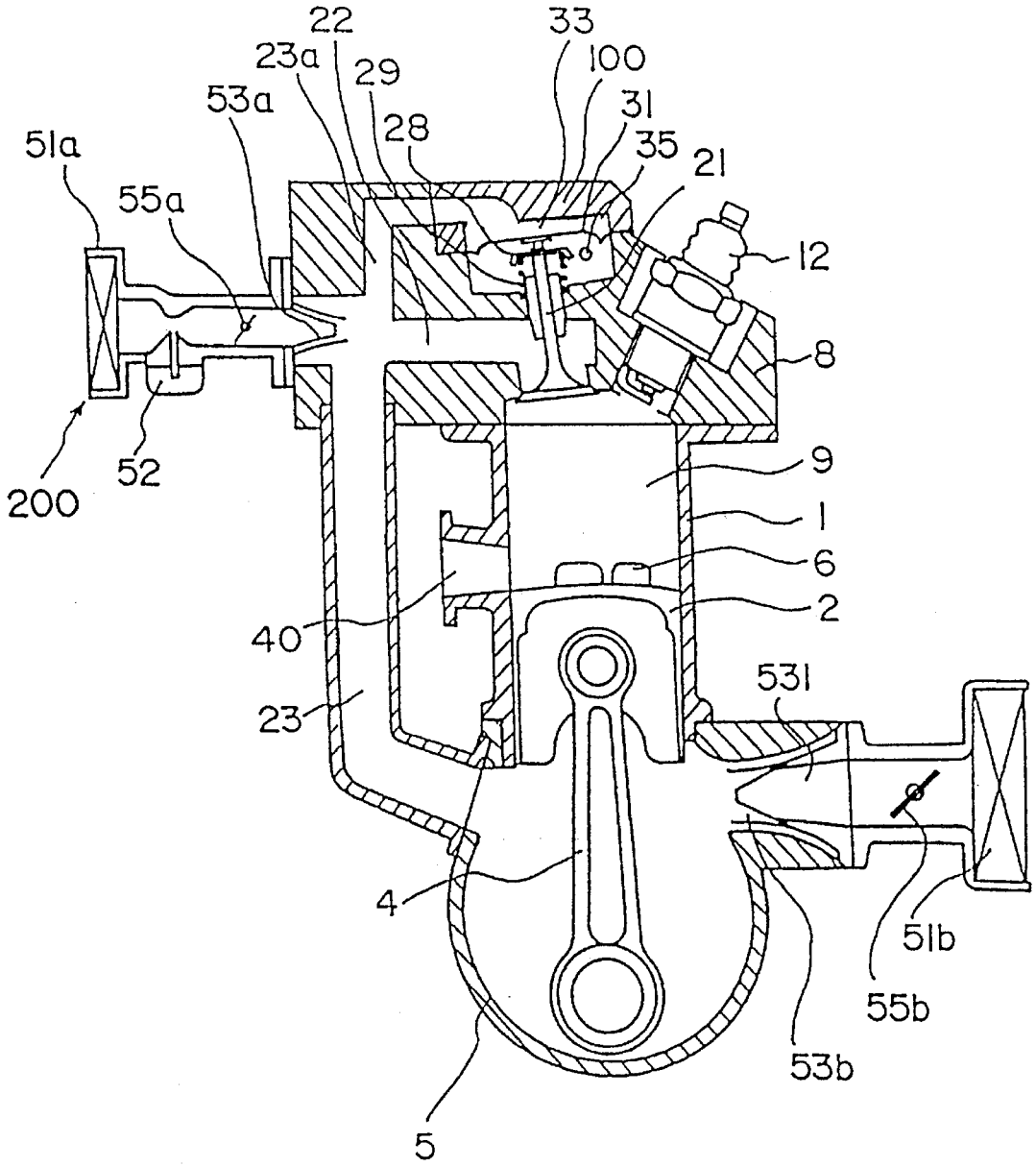
FIG. 6 is a schematic sectional view, similar to FIG. 1, of a crankcase compression type two-cycle engine in a fourth embodiment according to the present invention.

A crankcase compression type two-cycle engine in a fourth embodiment according to the present invention will be described hereinafter with reference to FIG. 6. As shown in FIG. 6, the engine is provided with a scavenging valve 21 driven, similarly to the scavenging valve 21 of the first embodiment, by the pressure of the compressed air prevailing within a scavenging passage 23 from a crankcase 5, and is provided, similarly to the engine in the second embodiment, with a fuel supply system 200 provided with a carburetor 52 and disposed near a scavenging port 22. The upper part of the scavenging passage 23 is branched into an operating air passage **23*a* and the scavenging port 2. The operating air passage 23*a* is connected to a pressure chamber 33 of a diaphragm actuator 100 to apply the pressure of the compressed air within the crankcase 5 to one side of the diaphragm 31 of the diaphragm actuator 100. The scavenging valve 21 is supported on a cylinder head 8 at the outlet of the scavenging port 22. When a reed valve 53*a* is opened, the fuel-air mixture made by the carburetor 52 of the fuel supply system 200 flows into the scavenging port 22**.

As the piston 2 moves downward, the internal pressure of the crankcase 5 increases and the pressure of the compressed air filling up the crankcase 5, the scavenging passage 23, the operating air passage **23*a* and the pressure chamber 33 acts on one side of the diaphragm 31. After an exhaust port 40 has been opened, the pressure within the combustion chamber 9 decreases and, when the pressure within the pressure chamber 33 exceeds the sum of the resilience of a valve spring 29 and the pressure within the combustion chamber 9 acting on the scavenging valve 21, the scavenging valve 21 is opened to allow the fuel-air mixture within the scavenging port 22 to flow into the combustion chamber 9**.

The gas flows past the scavenging valve 21 in an annular jet through an annular passage having a shape dependent on the circumferential length and the lift of the scavenging valve 21. When the fuel-air mixture flows in an annular jet, a negative pressure is produced in the central region of the annular jet and part of the combustion gas is liable to stay on in the central region of the annular jet of the fuel-air mixture. Furthermore, since the outer part of the annular jet tends to adhere to the inner circumference of the cylinder, the gas tends to remain below the scavenging valve 21. In a cylinder provided with a plurality of scavenging valves 21, jets of fuel-air mixture tend to flow in the central region of the interior of the cylinder, and the space where the jets become weak is reduced and the residual combustion gas is reduced.

The relation between the diameter D of the valve head, the sectional area S of the valve head and the circumferential length L of the valve head are expressed by:

$$S=\pi D^2/4 \quad (1)$$

$$L=\pi D \quad (2)$$

$$S=\pi L2/4\pi \quad (3)$$

Therefore, the sectional area S is directly proportional to $L^2$.

Since the relation between the sectional area Sj of the jet and the lift h of the scavenging valve 21 is expressed by:

$$Sj=L\cdot h \quad (4)$$

the sectional area Sj is directly proportional to L. Accordingly, if a plurality of scavenging valves is used and the sum of the sectional areas of the plurality of scavenging valves is equal to the sectional area S of a single scavenging valve, the sum of the sectional areas of the jets flowing past the plurality of scavenging valves is greater than the sectional area of the jet flowing past the single scavenging valve. Accordingly, it is advantageous in preventing the deterioration of engine performance due to intake pressure loss and the like to use a plurality of scavenging valves having a smaller diameter.

Figure 7:
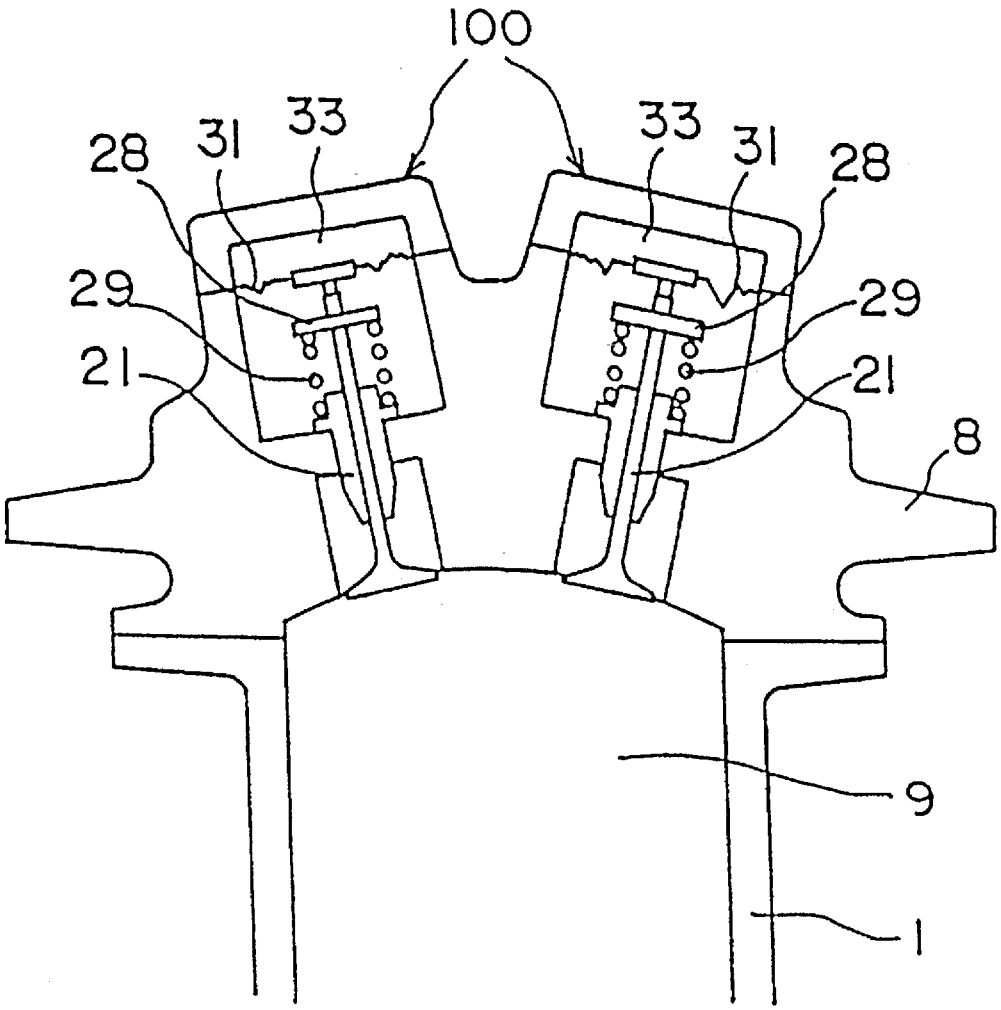
FIG. 7 is a schematic, fragmentary sectional view of a crankcase compression type two-cycle engine in a fifth embodiment according to the present invention.
Figure 8:
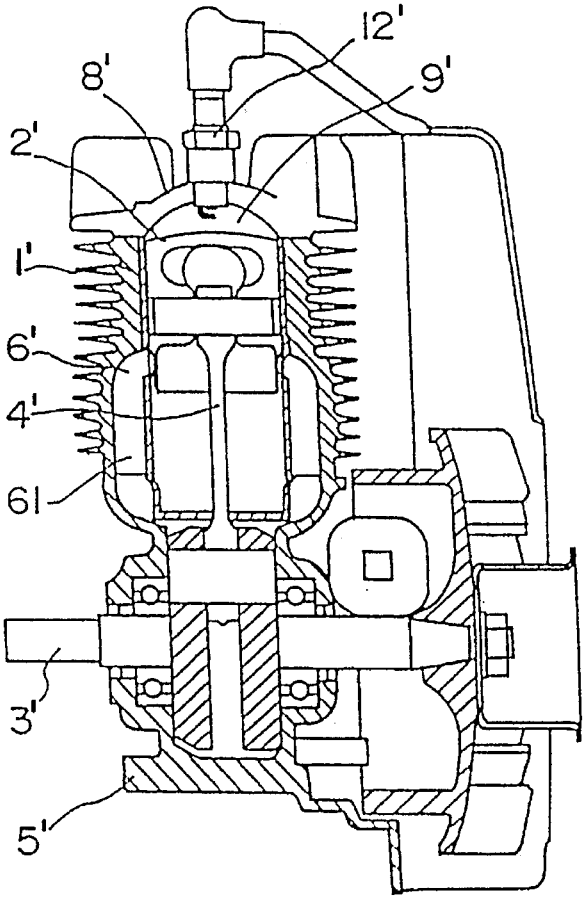
FIG. 8 (PRIOR ART)
FIG. 8 is a schematic sectional view of a conventional Schnüle scavenging type two-cycle engine.
Figure 9:
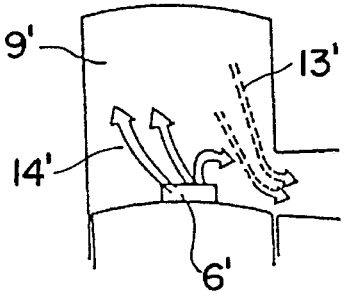
FIG. 9 (PRIOR ART)
FIG. 9 is a diagrammatic view illustrating the flow pattern of the gas exchange in the two-cycle engine of FIG. 8.

With this advantage of using a plurality of scavenging valves in view, a crankcase compression type two-cycle engine in a fifth embodiment according to the present invention shown in FIG. 7 is provided with two scavenging valve arrangement each having a scavenging valve 21 and a diaphragm actuator 100 which are similar in construction to the scavenging valve 21 and the diaphragm actuator 100 employed in the fourth embodiment. Excepting the number and arrangement of the scavenging valves 21 and the diaphragm actuators 100, the engine in the fifth embodiment is substantially the same in construction as those in the first and fourth embodiments.

As is apparent from the foregoing description, the crankcase compression type two-cycle engine of the present invention has a construction equivalent to a combination of the construction of the Schnüle scavenging type two-cycle engine and a comparatively simple mechanism, does not need such a complex valve operating mechanism as that employed in the uniflow scavenging type two-cycle engine, and is capable of effectively suppressing, similarly to the uniflow scavenging type two-cycle engine, the blowby of the fuel-air mixture. Accordingly, the crankcase compression type two-cycle engine of the present invention operates with low fuel consumption at a high efficiency and discharges an exhaust gas having a comparatively small hydrocarbon concentration.

While there has been described preferred embodiments of the invention, obviously modifications and variations are possible in the light of the above teachings. It is therefore to be understood that within the scope of the appended claims, the invention may be practiced other than as specifically described herein.

What is claimed is:

1. A crankcase compression type single-cylinder two-cycle engine comprising:

a single crankcase;

a single cylinder communicating with said single crankcase;

a piston slidably mounted in said cylinder for movement between a top dead center position and a bottom dead center position, said piston partitioning said cylinder into a combustion chamber and a crank chamber, said combustion chamber having a first end adjacent said crank chamber and a second end remote from said crank chamber;

an air inlet opening into said crank chamber via a check valve;

an exhaust port provided in said first end of said combustion chamber;

a scavenging intake port provided in said first end of said combustion chamber adjacent said exhaust port and being in communication with said crank chamber;

an intake port opening into said second end of said combustion chamber, said intake port confronting an end of said piston;

a poppet type scavenging valve movably mounted in said intake port and confronting said end of said piston so as to be movable towards and away from said end of said piston;

a scavenging valve operating mechanism operably connected to said scavenging valve for opening said scavenging valve when said piston is located adjacent said bottom dead center position;

a scavenging passage communicating said intake port with said crank chamber; and a fuel supply device communicating with said scavenging passage upstream of said intake port.

2. A crankcase compression type single-cylinder two-cycle engine as recited in claim 1, further comprising means for opening and closing said exhaust port and said scavenging intake port such that opening of said scavenging intake port is offset in time relative to opening of said exhaust port, and closing of said scavenging intake port is offset in time relative to closing of said exhaust port.

3. A crankcase compression type single-cylinder two-cycle engine as recited in claim 2, wherein said scavenging intake port, said intake port and said exhaust port together constitute a means for carrying out scavenging from both said first end and said second end of said combustion chamber.

4. A crankcase compression type single-cylinder two-cycle engine as recited in claim 1, wherein said scavenging intake port, said intake port and said exhaust port together constitute a means for carrying out scavenging from both said first end and said second end of said combustion chamber.

5. A crankcase compression type single-cylinder two-cycle engine as recited in claim 1, wherein said scavenging valve operating mechanism comprises an electromagnetic solenoid operably connected to said scavenging valve, and a crank angle sensor operably coupled with said electromagnetic solenoid.

6. A crankcase compression type single-cylinder two-cycle engine as recited in claim 1, wherein said scavenging valve operating mechanism comprises a scavenging valve chamber, a diaphragm operably coupled with said scavenging valve and partitioning said scavenging valve into a pressure chamber and a valve chamber, said pressure chamber being communicated with said crank chamber to receive pressure therefrom, and a spring biasing said scavenging valve towards a closed position.

7. A crankcase compression type single-cylinder two-cycle engine as recited in claim 6, wherein said pressure chamber is communicated with said crank chamber via said scavenging passage.

8. A crankcase compression type single-cylinder two-cycle engine as recited in claim 1, wherein said fuel supply device comprises a carburetor connected to said scavenging passage via a reed valve.

9. A crankcase compression type single-cylinder two-cycle engine as recited in claim 1, wherein said fuel supply device comprises a fuel injector disposed in said scavenging passage, and a fuel pump operably connected to said fuel injector.

10. A crankcase compression type single-cylinder two-cycle engine as recited in claim 1, further comprising a throttle valve mounted in said scavenging passage.

11. A crankcase compression type single-cylinder two-cycle engine as recited in claim 1, further comprising at least one additional intake port opening into said second end of said combustion chamber, said at least one additional intake port confronting said end of said piston; and at least one additional poppet type scavenging valve movably mounted in said at least one additional intake port and confronting said end of said piston so as to be movable towards and away from said end of said piston.

12. A crankcase compression type single-cylinder two-cycle engine as recited in claim 1, wherein said air inlet opening is an air-only inlet opening for allowing only air to flow into said crank chamber.

13. A crankcase compression type single-cylinder two-cycle engine as recited in claim 12, wherein upon downward movement of said piston toward said bottom dead center position, the air introduced into said crank chamber through said air inlet opening is compressed, a first portion of the compressed air is forced to flow into said combustion chamber through said scavenging intake port, and a second portion of the compressed air is forced to flow to said intake port through said scavenging passage.

14. A crankcase compression type single-cylinder two-cycle engine as recited in claim 1, wherein upon downward movement of said piston toward said bottom dead center position, the air introduced into said crank chamber through said air inlet opening is compressed, a first portion of the compressed air is forced to flow into said combustion chamber through said scavenging intake port, and a second portion of the compressed air is forced to flow to said intake port through said scavenging passage.

15. A crankcase compression type single-cylinder two-cycle engine as recited in claim 1, wherein said fuel supply device is disposed in said scavenging passage between said intake port and said crank chamber.

* * * * *